US011812219B2

(12) United States Patent
Li et al.

(10) Patent No.: US 11,812,219 B2
(45) Date of Patent: Nov. 7, 2023

(54) ASYMMETRY SOUND ABSORBING SYSTEM VIA SHUNTED SPEAKERS

(71) Applicant: Toyota Motor Engineering & Manufacturing North America, Inc., Plano, TX (US)

(72) Inventors: Xiaopeng Li, Ann Arbor, MI (US); Ziqi Yu, Ann Arbor, MI (US); Jae Seung Lee, Ann Arbor, MI (US); Danil V. Prokhorov, Canton, MI (US); Taehwa Lee, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 283 days.

(21) Appl. No.: 17/384,125

(22) Filed: Jul. 23, 2021

(65) Prior Publication Data

US 2023/0032254 A1 Feb. 2, 2023

(51) Int. Cl.

| | |
|---|---|
| ***H04R 1/28*** | (2006.01) |
| ***H04R 3/02*** | (2006.01) |
| ***G10K 11/02*** | (2006.01) |
| ***G10K 11/16*** | (2006.01) |

(Continued)

(52) U.S. Cl.

CPC ..... *H04R 1/288* (2013.01); *H04R 1/2892* (2013.01); *H04R 1/30* (2013.01); *H04R 3/02* (2013.01); *H04R 9/06* (2013.01)

(58) Field of Classification Search

CPC ..... H04R 1/28; H04R 1/2803; H04R 1/2807; H04R 1/2811; H04R 1/2869;

(Continued)

(56) References Cited

U.S. PATENT DOCUMENTS 4,109,108 A * 8/1978 Coxon ..... G10K 11/17857 381/71.5
4,122,303 A * 10/1978 Chaplin ..... G10K 11/17881 381/71.13

(Continued)

FOREIGN PATENT DOCUMENTS

CN 107786926 A * 3/2018 ..... H04R 3/00
CN 108932939 A * 12/2018 ..... G10K 11/16

(Continued)

OTHER PUBLICATIONS

Lissek et al., "Electroacoustic Absorbers: Bridging the Gap Between Shunt Loudspeakers and Active Sound Absorption," The Journal of the Acoustical Society of America, 129, 2968, 12 pages, (2011).

(Continued)

*Primary Examiner* — Edgardo San Martin

(74) *Attorney, Agent, or Firm* — Christopher G. Darrow; Darrow Mustafa PC

(57) ABSTRACT

Embodiments for one-way sound absorbing systems are described herein. In one example, a sound absorbing system includes a waveguide having open ends for receiving an incoming acoustic wave and wall portions defining a first port and a second port. A first electroacoustic absorber is mounted to the first port and is electrically connected to a shunting circuit, while a second electroacoustic absorber is mounted to the second port and is electrically connected to an open circuit. The sound absorption of the system is directional dependent.

20 Claims, 4 Drawing Sheets

(51) Int. Cl.
*G10K 11/18* (2006.01)
*H04R 1/30* (2006.01)
*H04R 9/06* (2006.01)

(58) Field of Classification Search
CPC .... H04R 1/2873; H04R 1/2876; H04R 1/288; H04R 1/2892; H04R 1/30; H04R 3/00; H04R 3/002; H04R 3/02; H04R 9/06; G10K 2210/112; G10K 2210/3224; G10K 2210/3228; G10K 2210/3229; G10K 11/002; G10K 11/02; G10K 11/16; G10K 11/175; G10K 11/172; G10K 11/178; G10K 11/22; G10K 11/20
See application file for complete search history.

(56) References Cited

U.S. PATENT DOCUMENTS

| | | | | | |
|---|---|---|---|---|---|
| 4,171,465 | A * | 10/1979 | Swinbanks | G10K 11/17875 | 381/71.5 |
| 4,473,906 | A * | 9/1984 | Warnaka | H03H 21/0025 | 367/901 |
| 4,669,122 | A * | 5/1987 | Swinbanks | G10K 11/17875 | 381/71.5 |
| 5,060,271 | A * | 10/1991 | Geddes | F01N 1/065 | 381/71.5 |
| 5,347,585 | A * | 9/1994 | Taki | G10K 11/17873 | 381/71.5 |
| 6,195,442 | B1 * | 2/2001 | Griffin | H04R 9/025 | 381/396 |
| 6,847,722 | B1 * | 1/2005 | Uosukainen | G10K 11/17873 | 381/71.7 |
| 8,836,792 | B1 * | 9/2014 | Butler | G01S 7/537 | 348/163 |
| 11,671,747 | B2 * | 6/2023 | Li | H04R 1/288 | 381/354 |

FOREIGN PATENT DOCUMENTS

| | | | | | |
|---|---|---|---|---|---|
| CN | 110364138 | A | * | 10/2019 | |
| CN | 111696511 | A | * | 9/2020 | |
| CN | 112104956 | A | * | 12/2020 | |
| CN | 112233638 | A | * | 1/2021 | |
| CN | 112901887 | A | * | 6/2021 | |
| FR | 2955731 | A1 | * | 7/2011 | H04R 1/2826 |
| GB | 2532794 | A | | 6/2016 | |
| KR | 20010091445 | A | * | 10/2001 | G10K 11/172 |
| KR | 20160027686 | A | * | 3/2016 | |
| WO | WO-2013114807 | A1 | * | 8/2013 | G10K 11/172 |
| WO | WO-2014195473 | A1 | * | 12/2014 | G10K 11/178 |

OTHER PUBLICATIONS

Boulandet et al., "Duct modes damping through an adjustable electroacoustic liner under grazing incidence," Journal of Sound and Vibration, pp. 1-18 (2018).
Fleming et al., "Control of Resonant Acoustic Sound Fields by Electrical Shunting of a Loudspeaker," IEEE Transactions on Control Systems Technology, vol. 15, No. 4, pp. 689-703, Jul. 2007.
Rivet et al., "Broadband low-frequency electroacoustic absorbers through hybrid sensor-/shunt-based impedance control," IEEE Transactions on Control Systems Technology, 25(1), pp. 1-11 (2016).
Pietrzko et al., "Noise reduction in a duct using passive/semiactive shunt loudspeakers," 16th International Congress on Sound and Vibration, Kraków, Poland, Jul. 5-9, 2009, pp. 1-8.
Cong et al., "A Multi-Tone Sound Absorber Based on an Array of Shunted Loudspeakers," Appl. Sci. 2018, 8(12), 2484, pp. 1-12.
Zhang et al., "Dual Frequency Sound Absorption with an Array of Shunt Loudspeakers," Scientific reports, 10(1), 1-8 (2020).

* cited by examiner

FIG. 3
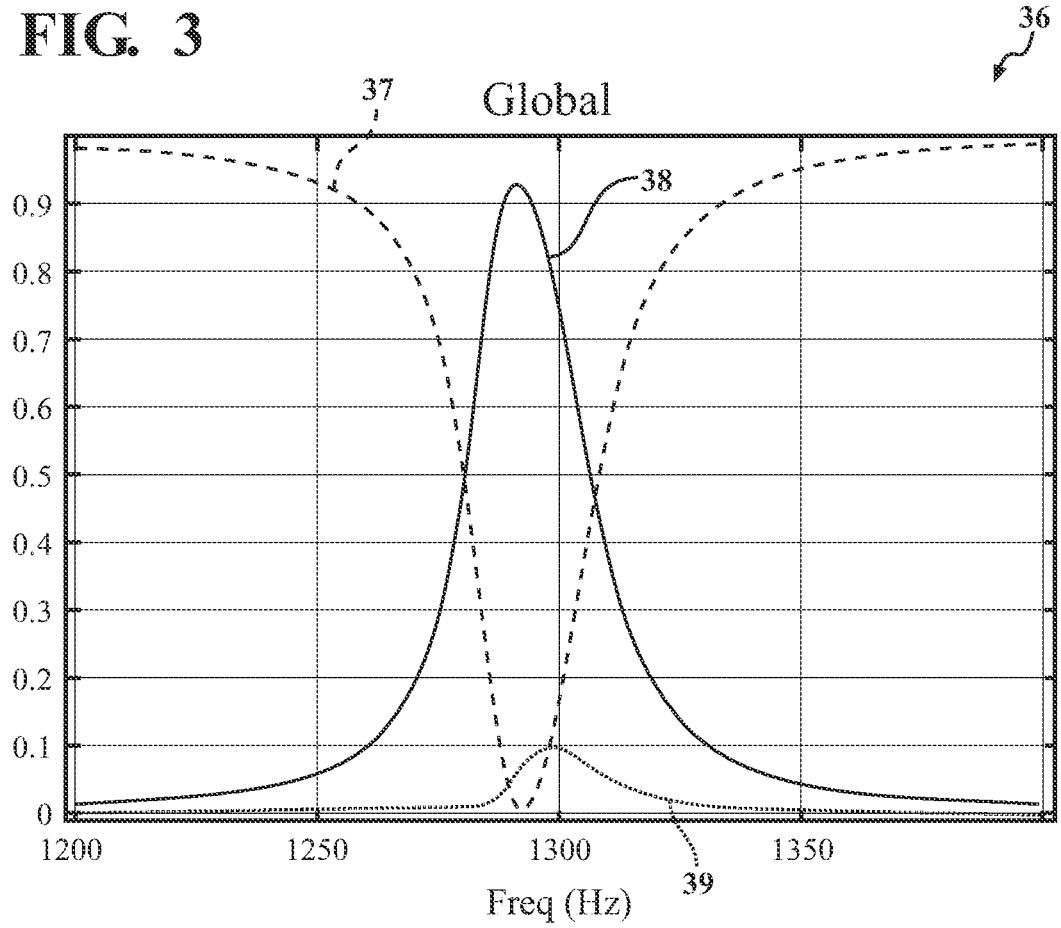
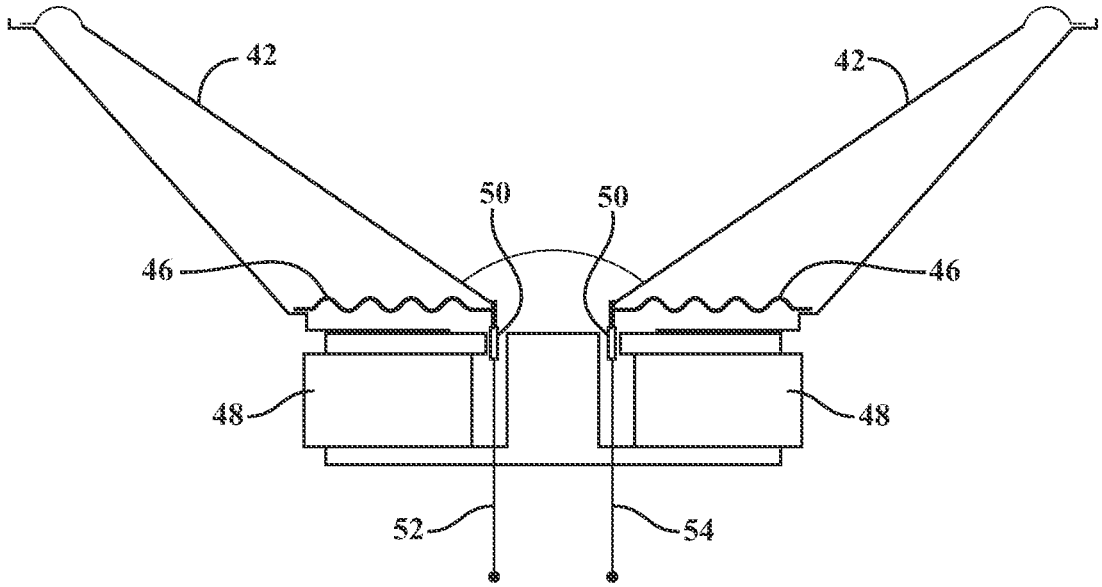
FIG. 4

FIG. 5
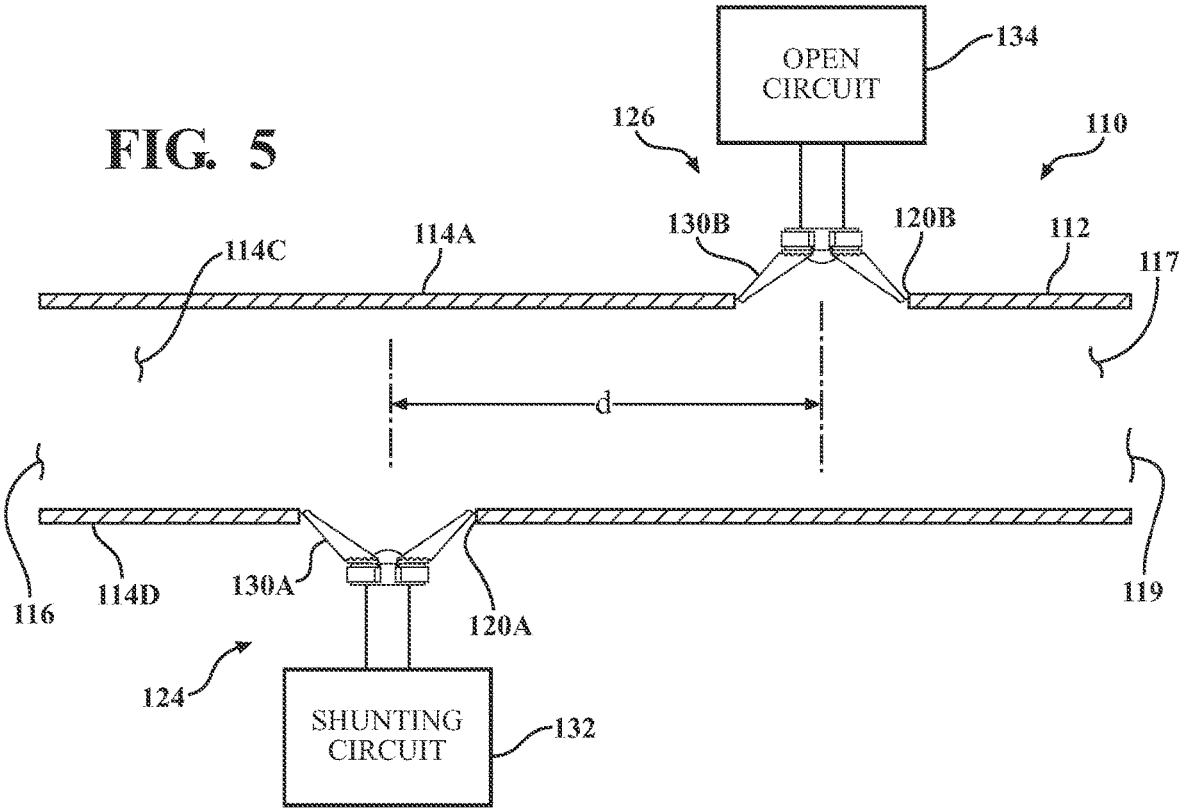
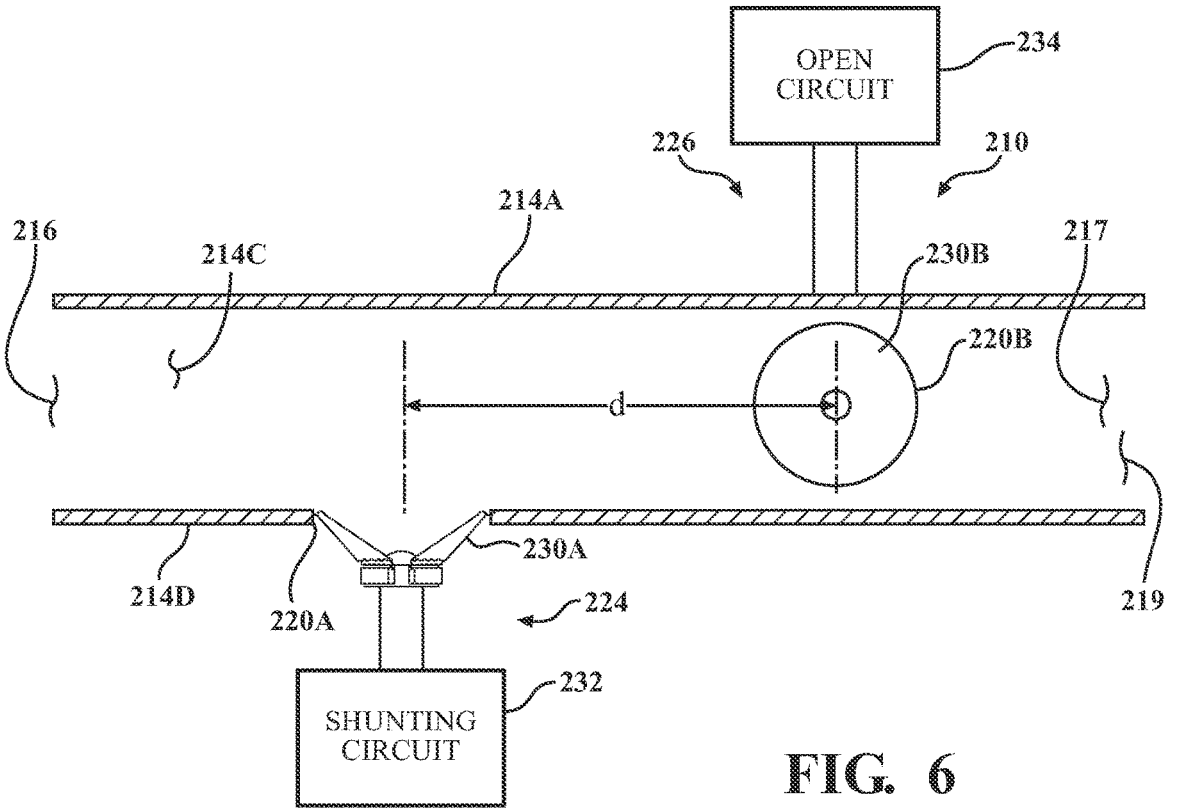
FIG. 6

ASYMMETRY SOUND ABSORBING SYSTEM VIA SHUNTED SPEAKERS

TECHNICAL FIELD

The subject matter described herein relates, in general, to a sound absorbing system and, more specifically, to an asymmetrically loaded sound absorber with reconfigurable loudspeakers in a two-port system.

BACKGROUND

The background description provided is to present the context of the disclosure generally. Work of the inventors, to the extent it may be described in this background section, and aspects of the description that may not otherwise qualify as prior art at the time of filing, are neither expressly nor impliedly admitted as prior art against the present technology.

The management of sound, especially sound that may be annoying or otherwise problematic, may be performed using a number of different methodologies. One methodology for the management of sound is active noise cancellation. Active noise cancellation is a method for reducing unwanted acoustic waves by introducing a canceling acoustic wave. Using the notion of destructive interference, the acoustic waves combine to form a new wave that greatly reduces or eliminates amplitude.

Another methodology for the management of sound is passive sound absorption. Passive sound absorption is when a material, structure, or object takes in sound energy when acoustic waves are encountered. Part of the absorbed energy is transformed into heat, and part of the absorbed energy is transmitted through the absorbing body. Conventional sound absorption materials must be undesirably thick to possess effective absorption efficiency. Such thick materials occupy an undesirably high volume in a limited space and increase cost. On the other hand, thin acoustic absorbing materials based on acoustic resonance have a very narrow effective frequency range. Such structures also can be sensitive to the incident angle of sound, leading to poor absorption for oblique angles. However, the conventional ways of sound absorption/reflection are symmetric, in which the sound wave is excited from one side, or the other side—the absorption/reflection coefficients are the same.

SUMMARY

This section generally summarizes the disclosure and does not comprehensively explain its full scope or all its features.

In one example, a one-way sound absorbing system includes a waveguide having an open end for receiving an incoming acoustic wave and wall portions defining a first port and a second port. A first electroacoustic absorber is mounted to the first port and is electrically connected to a shunting circuit, while a second electroacoustic absorber is mounted to the second port and is electrically connected to an open circuit. The first and second electroacoustic absorbers may be separated by a distance being less than one-quarter of the wavelength of the incoming acoustic wave.

In another example, a system for absorbing an incoming acoustic wave includes a first electroacoustic absorber being electrically connected to a shunting circuit and a second electroacoustic absorber being electrically connected to an open circuit. The first electroacoustic absorber and the second electroacoustic absorber are arranged along a direction defined by a direction of travel of the incoming acoustic wave.

Further areas of applicability and various methods of enhancing the disclosed technology will become apparent from the description provided. The description and specific examples in this summary are intended for illustration only and are not intended to limit the scope of the present disclosure.

BRIEF DESCRIPTION OF THE DRAWINGS

The accompanying drawings, which are incorporated in and constitute a part of the specification, illustrate various systems, methods, and other embodiments of the disclosure. It will be appreciated that the illustrated element boundaries (e.g., boxes, groups of boxes, or other shapes) in the figures represent one embodiment of the boundaries. In some embodiments, one element may be designed as multiple elements, or multiple elements may be designed as one element. In some embodiments, an element shown as an internal component of another element may be implemented as an external component and vice versa. Furthermore, elements may not be drawn to scale.

FIG. 3 is a chart that illustrates the reflection, absorption, and transmission of an incoming acoustic wave by the sound absorber system, in which almost total absorption can be achieved.

FIG. 4 illustrates a more detailed view of a loudspeaker that may be connected to a shunting circuit or an open circuit and form part of the one-way sound absorber system of FIG. 1.

FIG. 5 illustrates a variation of the one-way sound absorber system of FIG. 1 having two ports that substantially face each other.

FIG. 6 illustrates a variation of the sound absorber system of FIG. 1 having two separate ports that are angled with respect to each other.

DETAILED DESCRIPTION

Described is a one-way sound absorbing system that may include a waveguide having two open ends for receiving an acoustic wave and two ports formed within wall portions of the waveguide. Mounted within the ports are electroacoustic absorbers that may be in the form of loudspeakers, which can be simplified as a lumped mass-spring system. The electroacoustic absorber mounted within the port nearest the left open end of the waveguide may be connected to a shunting circuit, which can provide a damping effect to the absorber, while the electroacoustic absorber mounted within the port nearest from the right open end of the waveguide may be connected to an open circuit to minimize the damping effect of the absorber.

When only the electroacoustic absorber connected to the shunting circuit is placed in the waveguide, no matter which side the acoustic wave is incident to the waveguide with an appropriate frequency range, due to the geometric symmetry, the wave absorptions are the same, and it is partially absorbed. It has been observed that the acoustic wave may be 50% absorbed by the electroacoustic absorber that is connected to the shunting circuit.

In another case, the acoustic wave is totally reflected in the waveguide with only one electroacoustic absorber connected to the open circuit embedded in the waveguide due to the lossless resonator. This electroacoustic absorber totally reflects the acoustic wave towards the incident direction, which is referred as a perfect reflector. To increase the absorption performance, two electroacoustic absorbers with shunting circuits can be arranged in the waveguide. Generally, such an arrangement may absorb a significant portion of the incoming acoustic wave. In one example, a significant portion of the incoming wave could be greater than 70% and may be even as high as 100%, but the absorption is symmetric.

Figure 1:
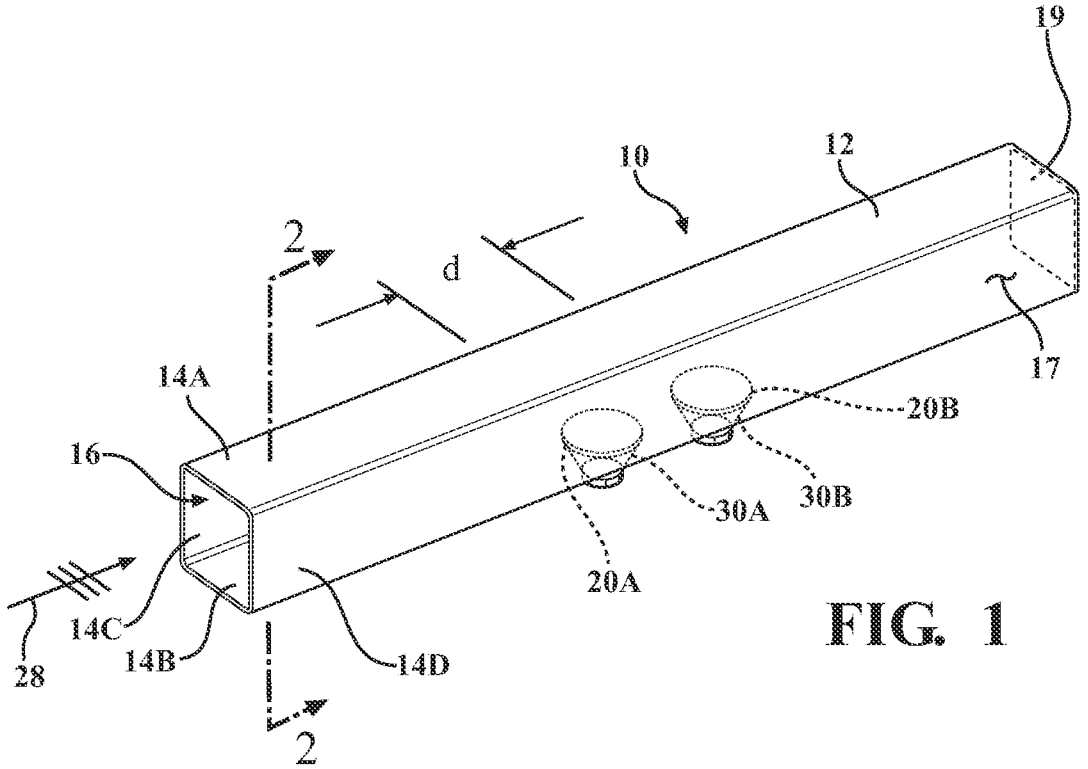
FIG. 1 illustrates an example of a one-way sound absorber system.

Referring to FIG. 1, illustrated is one example of the one-way sound absorbing system 10. Here, the one-way sound absorbing system 10 includes a waveguide 12 that may include one or more wall portions, such as wall portions 14A-14D. In this example, the waveguide 12 is generally in the form of a duct, but it should be understood that the waveguide 12 may take any one of several different forms. For example, instead of being a duct, the waveguide 12 may be more circular and may resemble a pipe more than a duct.

The waveguide 12 is shown to include two open ends 16 and 17 (left, right, respectively, or first, second, respectively) for receiving an incoming acoustic wave 28. The two open ends 16 and 17 are generally opposite to each other. The two ends 16 and 17 may be either open or closed, with a sound source inside the waveguide for the closed end case.

Generally, the waveguide 12 and the wall portions 14A-14D are made of an acoustically hard material that can reflect acoustic waves. As such, the waveguide 12 and the wall portions 14A-14D may be made of metals, plastics, or other suitable acoustically hard material.

Formed within the wall portion 14B are ports 20A and 20B. The ports 20A and 20B may take any one of a number of different shapes. In this example, the ports 20A and 20B are circular in shape and are configured to allow the mounting of electroacoustic absorbers 30A and 30B within the ports 20A and 20B, respectively. Generally, the ports 20A and 20B, and therefore the electroacoustic absorbers 30A and 30B, are arranged along a direction substantially defined by the direction of travel of the acoustic wave 28. Moreover, the electroacoustic absorbers 30A and 30B may be arranged in a line and along the direction of travel of the acoustic wave 28. However, the cones of the electroacoustic absorbers 30A and 30B may face a direction that is perpendicular to the direction of travel of the acoustic wave 28.

As will be explained in greater detail later in this specification, the electroacoustic absorber 30A that is located nearest to the open end 16 (or the source of the incoming acoustic wave 28) will be electrically connected to a shunting circuit, while the electroacoustic absorber 30B that is located furthest from the open end 16 will be electrically connected to an open circuit. Generally, the electroacoustic absorbers 30A and 30B, and therefore the ports 20A and 20B, are separated from each other by a distance d. The distance d, as will be explained later, is based on the wavelength of the acoustic wave to be absorbed. In one example, the distance d may be less than one-quarter of the wavelength of the acoustic wave 28. Generally, less than one-quarter of the wavelength may be between 1% to 30% less than one-quarter of the wavelength of the acoustic wave to be absorbed.

Figure 2:
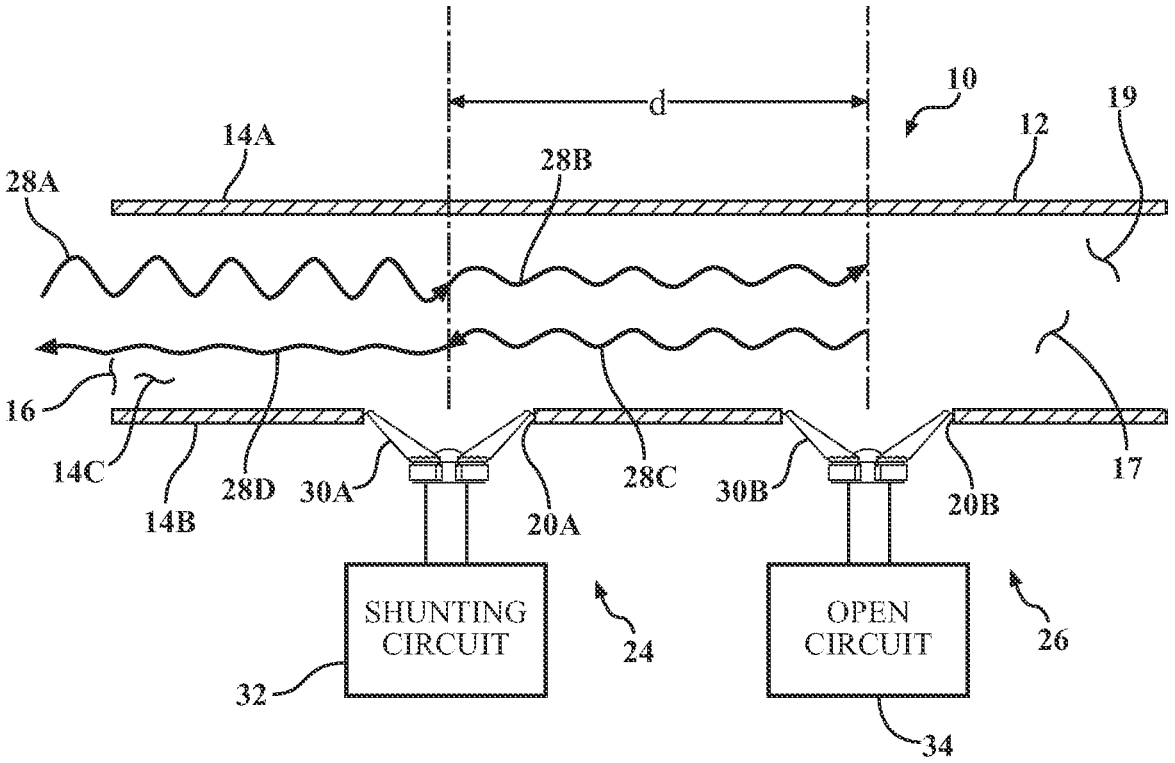
FIG. 2 illustrates a cutaway view of the sound absorber system of FIG. 1 generally taken along lines 2-2.

Referring to FIG. 2, a cutaway view of the sound absorbing system 10, generally taken along lines 2-2 of FIG. 1, is shown. Like before, FIG. 2 illustrates the sound absorbing system 10 having a waveguide 12 with wall portions 14A-14D. The wall portion 14B defines ports 20A and 20B in which the electroacoustic absorbers 30A and 30B are mounted.

Figure 7:
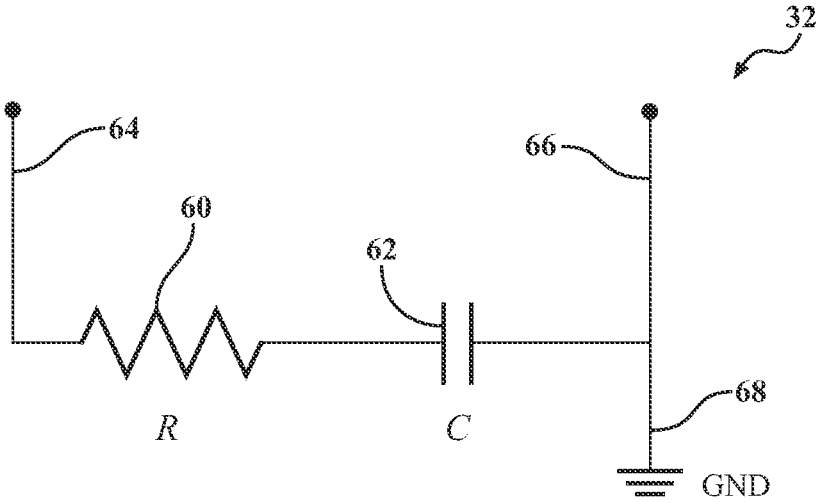
FIG. 7 illustrates one example of a shunting circuit for use with the sound absorber system.

The electroacoustic absorber 30A is part of an absorbing system 24. The absorbing system 24 includes the electroacoustic absorber 30A and a shunting circuit 32. The shunting circuit 32, described in more detail in FIG. 7, is electrically connected to the electroacoustic absorber 30A. The electroacoustic absorber 30B is part of a reflection system 26. The reflection system 26 includes the electroacoustic absorber 30B and an open circuit 34. The open circuit 34 could be a real open circuit when the damping effect of the speaker is neglectable or a negative resistor circuit realized with a feedback amplification circuit which is described in more detail in FIGS. 8A and 8B to cancel out the damping effect in the speaker. The open circuit is electrically connected to the electroacoustic absorber 30A.

FIG. 2 also illustrates an incoming acoustic wave 28A directed towards the open end 16 of the waveguide 12. Here, the incoming acoustic wave 28A has an amplitude. When the incoming acoustic wave 28A reaches the absorbing system 24, the absorbing system 24 absorbs a portion of the incoming acoustic wave 28A. In one example, the absorbing system 24 reduces the amplitude of the acoustic wave 28A by approximately 50%. However, it should be understood that the portion absorbed may vary and may be greater than or less than 50%. Approximately 50% used within the specification, in one example, could vary between 35% to 70%.

Unabsorbed portions of the incoming acoustic wave 28A are represented by the acoustic wave 28B. Here, the acoustic wave 28B is directed by the waveguide 12 towards the reflection system 26. Upon reaching the reflection system 26, the acoustic wave 28B is substantially reflected by the reflection system 26 back towards the open end 16 of the waveguide 12. Substantially reflected may be a 100% reflection of the acoustic wave 28B but could also vary between 70% to 100%.

The reflected portions of the acoustic wave 28B is illustrated in this example as acoustic wave 28C. The acoustic wave 28C is directed back towards the open end 16 of the waveguide 12 and therefore towards the absorbing system 24. Upon reaching the absorbing system 24, the absorbing system 24 absorbs at least a portion of the acoustic wave 28C. In one example, the acoustic wave 28C may be substantially absorbed by the absorbing system 24. Substantially absorbed should be understood to mean approximately 90% to 100% of the acoustic wave 28C. In other examples, only a portion of the acoustic wave 28C may be absorbed. Only a portion of the acoustic wave absorbed may be approximately 50% of the acoustic wave 28C but could vary between 35% and 70%. If only a portion of the acoustic wave 28C is absorbed, the unabsorbed portions of the acoustic wave, represented by acoustic wave 28D are directed back towards the open end 16 of the waveguide 12.

In effect, the acoustic wave 28A may be greatly reduced or eliminated by this sound absorbing system 10. In addition, it has generally been observed that very little if any of the acoustic wave 28 is transmitted through the waveguide 12 towards the second end 17, which may have an opening 19. As such, only a small portion, or even none at all, of the acoustic wave 28A provided to the sound absorbing system 10 may be reflected towards the open end 16 of the waveguide 12. For example, FIG. 3 illustrates a chart 36 detailing the transmission 37, absorption 38, and reflection 39 of an acoustic wave provided to the sound absorbing system 10. Here, an incoming acoustic wave with approximately 1280 Hz is substantially absorbed, with only a small amount being reflected towards the open end 16 of the sound absorbing system 10. Additionally, it is noted that there is virtually no transmission of the incoming acoustic wave towards the second end 17. When the acoustic wave is incident from the second end 17, the wave will be totally reflected. Therefore, the transmission and absorption coefficients are zero at the resonant frequency. In such a system, the absorption coefficient is direction-dependent, and one-way wave absorption is realized.

Referring to FIG. 4, illustrated is an example of an electroacoustic absorber 30 that may be utilized as the electroacoustic absorbers 30A and/or 30B. Here, the electroacoustic absorber 30 may be a traditional loudspeaker that includes a voice coil 50 and a magnet 48. The voice coil 50 includes connection lines 52 and 54. Upon receiving an appropriate signal via the connection lines 52 and 54, the voice coil 50 emits an electromagnetic field that interacts with the magnet 48, causing movement of the voice coil 50.

The voice coil 50 is mechanically connected to a cone 42 that may vibrate when the voice coil 50 moves in response to receiving the appropriate signal via the connection lines 52 and 54. The movement of the cone 42 causes the movement of air that creates an acoustic wave. As explained previously, based on the movement of the cone 42, the electroacoustic absorber 30 may either absorb or reflect an incoming acoustic wave when utilized within the sound absorbing system 10 described in the previous figures and paragraphs. The cone 42 may be connected to a spider 46 that regulates the movement of the cone 42. Generally, the electroacoustic absorber 30 is mounted such that the cone 42 substantially faces the interior of the waveguide 12.

The positioning of the electroacoustic absorbers 30A and 30B, as explained previously, is generally along a direction of travel of the incoming acoustic wave to be absorbed. However, while FIG. 2 illustrates that the electroacoustic absorbers 30A and 30B are mounted to the same wall portion 14D, which may be substantially planar, it should be understood that the electroacoustic absorbers 30A and 30B may be mounted on different wall portions that substantially face each other or angled with respect to each other.

For example, referring to FIG. 5, illustrated is another example of the sound absorbing system 110. In this example, like reference numerals have been utilized to refer to like elements, with the exception that the reference numerals have been incremented by 100. For example, the open end 116 of FIG. 5, is similar to the open end 16 of FIG. 2. Any previous or later explanation regarding these elements in the paragraphs above and FIG. 2 is equally applicable to the sound absorbing system 110 of FIG. 5.

The one-way sound absorbing system 110 of FIG. 5 is similar to the sound absorbing system 10 of FIG. 1. However, in this example, the port 120B, furthest from the open end 116 of the waveguide 112 is formed within the wall portion 114A of the waveguide 112. The wall portion 114A substantially faces the wall portion 114D. As such, the electroacoustic absorber 130B also substantially faces in a direction opposite of the electroacoustic absorber 130A. Notably, the distance d between the ports 120A and 120B, and therefore the electroacoustic absorbers 130A and 130B is unchanged. In addition, as stated previously, the second end 17 can be either opened or closed. In this example, the second end 117 is opened, as illustrated by the opening 119. However, the second end 117 may be closed.

FIG. 6 illustrates yet another example of a one-way sound absorbing system 210. Like before, like reference numerals have been utilized to refer to like elements, with the exception that the reference numerals have been incremented by 200. Using our previous example, the open end 216 of FIG. 6 is similar to the open end 16 of FIG. 2. Any previous or later explanation regarding these elements in the paragraphs above and FIG. 2 is equally applicable to the sound absorbing system 210 of FIG. 6.

The one-way sound absorbing system 210 of FIG. 6 is similar to the one-way sound absorbing system 10 of FIG. 1. However, in this example, the port 220B, furthest from the open end 216 of the waveguide 212 is formed within the wall portion 214C of the waveguide 112. The wall portion 214C is angled with respect to the wall portion 214D. As such, the electroacoustic absorber 230B is angled with respect to the electroacoustic absorber 230A. In this example, the wall portion 214C is angled with respect to the wall portion 214D at an angle of approximately 90°. However, it should be understood that this angle can vary significantly and can be any angle. Like before, the distance d between the ports 220A and 220B, and therefore the electroacoustic absorbers 230A and 230B, is unchanged.

As explained previously, the electroacoustic absorber 30A of FIG. 2 is electrically connected to a shunting circuit 32A. Referring to FIG. 7, a more detailed view of the shunting circuit 32 is shown. The shunting circuit 32 can take any one of a number of different forms. In this example, the shunting circuit 32 includes a resistor 60 connected in series with a capacitor 62. A terminal 64 is connected to one end of the resistor 60, opposite of the capacitor 62. A terminal 66 is connected to one end of the capacitor 62, opposite the resistor 60. The terminal 66 is grounded to and electrical ground 68. The terminals 64 and 66 are electrically connected to the electroacoustic absorber 30A. Referring to the electroacoustic absorber 30 of FIG. 4, the terminal 64 may be connected to the connection line 52, while the terminal 66 may be connected to the connection line 54.

The impedance of the resistor 60 and the capacitance of the capacitor 62 may be dependent on the frequency of the acoustic wave to be absorbed. In one example, the relationship between the values of the capacitor 62 and the frequency of the acoustic wave to be absorbed may be expressed as:

$$f_0 = \frac{1}{2\pi\sqrt{(1/LC)}},$$

where $f_0$ is the frequency of the acoustic wave to be absorbed, C is the capacitance of the capacitor 62, and L is the inductance of the electroacoustic absorber 30A. The impedance of the resistor 60 may be experimentally adjusted due to the intrinsic resistance and mechanical damping of the electroacoustic absorber 30A to reach an optimized value. Due to this damping effect, the peak absorption frequency ($f_0$) may be shifted at a small amount.

Figure 8A:
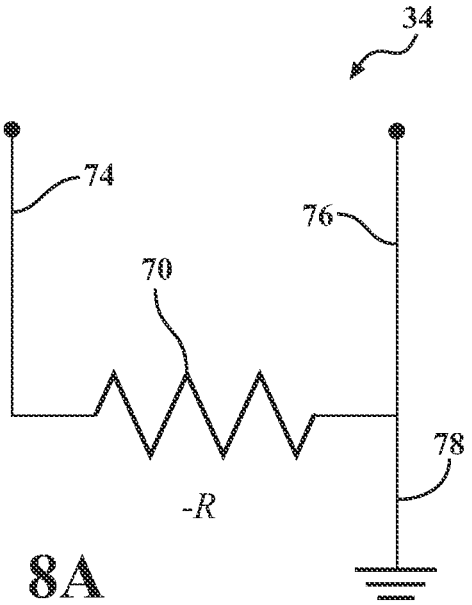
FIGS. 8A and 8B illustrate one example of an open circuit for use with the sound absorber system.

The electroacoustic absorber 30B of FIG. 2 is electrically connected to an "open circuit" 34. The "open circuit" could be a real opened circuit for the speaker when its damping effect is neglectable. Referring to FIG. 8A, when the speaker has non-neglectable damping, the "open circuit" 34 includes a negative resistor 70 with terminals 74 and 76 located at opposite ends of the negative resistor 70. The terminal 76 is also connected to an electrical ground 78. The terminals 74 and 76 are electrically connected to the electroacoustic absorber 30B. Referring to the electroacoustic absorber 30 of FIG. 4, the terminal 74 may be connected to the connection line 52, while the terminal 76 may be connected to the connection line 54. The value of the impedance of the negative resistor 70 may be based on experimental results to determine which value of the negative resistor 70 is appropriate for reflecting acoustic waves of a target frequency range while maintaining the stability of the system.

Negative resistance is a property of some electrical circuits and devices in which an increase in voltage across the terminals 74 and 76 results in a decrease in electric current through the open circuit 34. This contrasts with an ordinary resistor in which an increase of applied voltage causes a proportional increase in current due to Ohm's law, which results in positive resistance. A positive resistance consumes power from current passing through it, while negative resistance produces power. The negative resistor 70 may not be a traditional linear component, like a resistor, but may include additional components to achieve this effect.

Figure 8B:
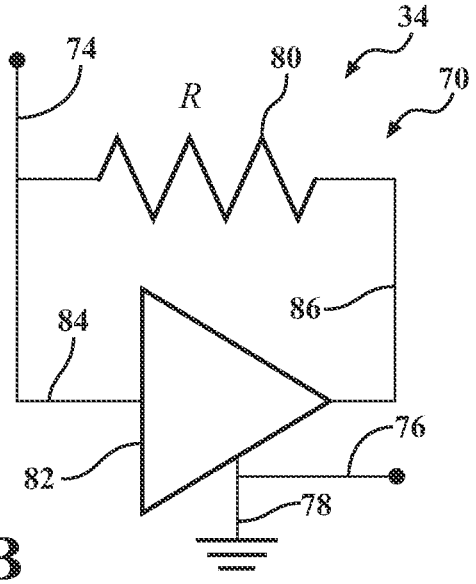

One such example of these components is illustrated in FIG. 8B. Like before, terminals 74 and 76 are illustrated, with terminal 76 electrical communication with the electrical ground 78. The negative resistor 70 includes a resistor 80 and an amplifier 82 having an input 84 and an output 86. The resistor 80 is connected in parallel to the amplifier 82. One end of the resistor 80 is connected to the terminal 74, while the other end of the resistor 80 is connected to the output 86 of the amplifier 82. This setup results in a decrease in electric current through the open circuit 34 when there is an increase in voltage across the terminals 74 and 76. As explained previously, the values of the resistor 80 may be based on experimental results to determine which value of the resistor 80 is appropriate for reflecting acoustic waves of a target frequency range.

The following includes definitions of selected terms employed herein. The definitions include various examples and/or forms of components that fall within the scope of a term and may be used for various implementations. The examples are not intended to be limiting. Both singular and plural forms of terms may be within the definitions.

References to "one embodiment," "an embodiment," "one example," "an example," and so on, indicate that the embodiment(s) or example(s) so described may include a particular feature, structure, characteristic, property, element, or limitation, but that not every embodiment or example necessarily includes that particular feature, structure, characteristic, property, element or limitation. Furthermore, repeated use of the phrase "in one embodiment" does not necessarily refer to the same embodiment, though it may.

The terms "a" and "an," as used herein, are defined as one or more than one. The term "plurality," as used herein, is defined as two or more than two. As used herein, the term "another" is defined as at least a second or more. The terms "including" and/or "having," as used herein, are defined as comprising (i.e., open language). The phrase "at least one of . . . and . . . " as used herein refers to and encompasses any and all possible combinations of one or more of the associated listed items. As an example, the phrase "at least one of A, B, and C" includes A only, B only, C only, or any combination thereof (e.g., AB, AC, BC, or ABC).

Aspects herein can be embodied in other forms without departing from the spirit or essential attributes thereof. Accordingly, reference should be made to the following claims, rather than to the foregoing specification, as indicating the scope hereof.

What is claimed is:

1. A system comprising:

a waveguide having an open end for receiving an incoming acoustic wave and wall portions defining a first port and a second port;

a first electroacoustic absorber mounted to the first port and being electrically connected to a shunting circuit; and a second electroacoustic absorber mounted to the second port and being electrically connected to an open circuit.

2. The system of claim 1, wherein:

the first port is located closer to a left open end and the second port is located closer to a right open end;

when an acoustic wave is incident from left to right, the acoustic wave will be totally absorbed; and when an acoustic wave is incident from right to left, the acoustic wave will be totally reflected without any absorption.

3. The system of claim 1, wherein the first electroacoustic absorber and the second electroacoustic absorber are separated by a distance, the distance being less than one-quarter of a wavelength of the incoming acoustic wave.

4. The system of claim 3, wherein the first electroacoustic absorber and the second electroacoustic absorber are arranged along a length of the waveguide.

5. The system of claim 1, wherein the first electroacoustic absorber absorbs a first portion of the incoming acoustic wave, allowing a second portion of the incoming acoustic wave to continue to the second electroacoustic absorber.

6. The system of claim 5, wherein the first portion of the incoming acoustic wave absorbed by the first electroacoustic absorber is approximately 50% of the incoming acoustic wave.

7. The system of claim 5, wherein the second electroacoustic absorber reflects the second portion of the incoming acoustic wave to the first electroacoustic absorber.

8. The system of claim 7, wherein the first electroacoustic absorber absorbs part of the second portion of the incoming acoustic wave reflected by the second electroacoustic absorber.

9. The system of claim 8, wherein the part of the second portion of the incoming acoustic wave absorbed is substantially all of the second portion of the incoming acoustic wave.

10. The system of claim 1, wherein the first port and the second port are defined within a planar wall portion of the waveguide.

11. The system of claim 1, wherein the first port is defined within a first wall portion of the waveguide and the second port is defined by a second wall portion of the waveguide.

12. The system of claim 11, wherein the first wall portion and the second wall portion substantially face each other or are angled with respect to each other.

13. The system of claim 1, wherein the open circuit is a real open circuit or a negative resistance circuit.

14. The system of claim 1, wherein the first electroacoustic absorber and the second electroacoustic absorber are loudspeakers.

15. A system for one-way or asymmetric absorbing an incoming acoustic wave comprising:

a first electroacoustic absorber being electrically connected to a shunting circuit;

a second electroacoustic absorber being electrically connected to an open circuit; and the first electroacoustic absorber and the second electroacoustic absorber being arranged along a direction defined by a direction of travel of the incoming acoustic wave.

16. The system of claim 15, wherein:

the first electroacoustic absorber is located on a left of a waveguide and the second electroacoustic absorber on a right of the waveguide;

the first electroacoustic absorber and the second electroacoustic absorber are separated by a distance, the distance being less than one-quarter of a wavelength of the incoming acoustic wave;

when an acoustic wave is incident from left to right, the acoustic wave will be totally absorbed; and when an acoustic wave is incident from right to left, the acoustic wave will be totally reflected without any absorption.

17. The system of claim 16, wherein the first electroacoustic absorber absorbs a first portion of the incoming acoustic wave, allowing a second portion of the incoming acoustic wave to continue to the second electroacoustic absorber.

18. The system of claim 17, wherein the first portion of the incoming acoustic wave absorbed by the first electroacoustic absorber is approximately 50% of the incoming acoustic wave.

19. The system of claim 17, wherein the second electroacoustic absorber reflects the second portion of the incoming acoustic wave back to the first electroacoustic absorber.

20. The system of claim 19, wherein the first electroacoustic absorber absorbs part of the second portion of the incoming acoustic wave reflected by the second electroacoustic absorber.

* * * * *